US008607514B2

(12) United States Patent
Peterson

(10) Patent No.: US 8,607,514 B2
(45) Date of Patent: Dec. 17, 2013

(54) WINDOW TRIM SYSTEM

(75) Inventor: Steven G. Peterson, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 237 days.

(21) Appl. No.: 13/090,607

(22) Filed: Apr. 20, 2011

(65) Prior Publication Data

US 2011/0258962 A1 Oct. 27, 2011

Related U.S. Application Data

(60) Provisional application No. 61/327,153, filed on Apr. 23, 2010.

(51) Int. Cl.
*E06B 1/00* (2006.01)

(52) U.S. Cl.
USPC ..... 52/212; 52/211; 52/656.5; 52/717.01

(58) Field of Classification Search
USPC ..... 52/208, 204.53, 204.54, 211, 212, 213, 52/215, 656.5, 656.6, 717.01, 718.01, 52/718.03
See application file for complete search history.

(56) References Cited

U.S. PATENT DOCUMENTS

| | | | | | |
|---|---|---|---|---|---|
| 2,733,787 | A | * | 2/1956 | Morra | 52/97 |
| 2,840,203 | A | * | 6/1958 | Hehr | 52/204.53 |
| 3,465,485 | A | * | 9/1969 | Knipper | 52/204.5 |
| 3,975,875 | A | * | 8/1976 | Goss, Jr. | 52/204.53 |
| 4,259,135 | A | * | 3/1981 | Kulla | 156/293 |
| 4,304,081 | A | * | 12/1981 | Dawson | 52/309.13 |
| 4,488,391 | A | * | 12/1984 | Pavnica | 52/745.16 |
| 4,532,915 | A | * | 8/1985 | de Rham | 126/242 |
| 4,811,533 | A | * | 3/1989 | Wetsel | 52/204.53 |
| 4,875,318 | A | * | 10/1989 | MacLeod et al. | 52/211 |
| 5,083,409 | A | * | 1/1992 | Pliml, Jr. | 52/656.9 |
| 5,349,799 | A | * | 9/1994 | Schiedegger et al. | 52/473 |
| 5,596,852 | A | * | 1/1997 | Schiedegger | 52/212 |
| 6,141,922 | A | * | 11/2000 | Carlisle et al. | 52/204.1 |
| 6,359,220 | B2 | * | 3/2002 | Schiedegger et al. | 174/50 |
| 6,389,763 | B1 | * | 5/2002 | Clauss | 52/204.53 |
| 6,634,146 | B2 | * | 10/2003 | Carlson | 52/204.55 |
| 6,763,638 | B1 | * | 7/2004 | Berger, Jr. | 52/204.6 |
| 2003/0172596 | A1 | * | 9/2003 | Talley et al. | 52/19 |
| 2004/0010989 | A1 | * | 1/2004 | Rivest | 52/204.5 |
| 2009/0100785 | A1 | * | 4/2009 | Tanner | 52/717.01 |
| 2009/0193728 | A1 | * | 8/2009 | Butler et al. | 52/213 |
| 2011/0005153 | A1 | * | 1/2011 | Schield | 52/204.53 |
| 2012/0055107 | A1 | * | 3/2012 | Butler et al. | 52/213 |

FOREIGN PATENT DOCUMENTS

| | | | |
|---|---|---|---|
| JP | 4-357290 | * | 12/1992 |

* cited by examiner

*Primary Examiner* — Robert Canfield
(74) *Attorney, Agent, or Firm* — Womble Carlyle Sandridge & Rice, LLP

(57) ABSTRACT

A window trim system and method comprises a trim hoop sized to be slid over an outer face of a window frame to the exterior edge of the frame. A stop member formed around the exterior edge abuts and aligns the trim hoop. A friction member may or may not be installed around the inside of the trim hoop to help hold the trim hoop initially in place. Sealant is then applied around the junction of the trim hoop and window frame on the inside of the trim hoop to fix the trim hoop to the window frame and create a seal against air and water infiltration. The resulting window frame and trim assembly is particularly suited for use in an overfit replacement window installation, but may be used in virtually any window installation.

20 Claims, 5 Drawing Sheets

WINDOW TRIM SYSTEM

REFERENCE TO RELATED APPLICATION

Priority is hereby claimed to the filing date of U.S. provisional patent No. 61/327,153 filed on 23 Apr. 2010.

TECHNICAL FIELD

This disclosure relates generally to fenestration and more specifically to windows with decorative trim and methods of applying decorative trim to windows.

BACKGROUND

It has long been common to apply decorative trim around window frames on the exterior side of a dwelling. For traditional wooden window frames, this typically is done by nailing trim to the exterior edges of the window frame surrounding the window opening. For vinyl and composite window frames, exterior trim may be supplied in a number of ways. For example, some suppliers extrude an exterior window frame as an integral component of the window frame extrusion. This is exemplified in FIGS. 1*a*, 1*b*, and 1*c*, which illustrate in cross section various configurations of window frames 11 having an exterior trim 12 integrally extruded therewith. While this technique is somewhat effective, it requires much larger and more expensive extrusion dies and more complicated extruders, which is a drawback in manufacturing. Further, the style of frame 12 is practically fixed once the extrusion die is fabricated. Finally, making window frames from such extrusions is somewhat difficult because the entire extrusion must be mitered and joined together with great precision to avoid mismatched miter joints or gaps where the lineals of the frame join together. Thus, the unitary extrusion technique has not been completely satisfactory.

Other suppliers of extruded window frames provide separate trim extrusions that can be attached to a corresponding extruded window frame with foam tape or other adhesive and/or fasteners. This technique is exemplified in FIGS. 2*a* and 2*b*, which illustrate in cross section an extruded window frame lineal 13 and a separately extruded exterior frame lineal 14 having an attachment leg 15. Foam tape 16 or VHB is disposed on the leg 15. To attach the trim 14 to the window frame 13, a release layer is removed from the foam tape 16 and the leg 15 of the trim is pressed and secured onto the outer peripheral face of the extruded frame as illustrated in FIG. 2*b*. Fasteners 17, such as screws or staples, also may be driven through the leg 15 and into the body of the frame 13 to secure the trim further to the window frame lineal. While this technique addresses some of the problems associated, for example, with large extrusion dies and fixed trim profiles, it nevertheless requires that the exterior trim lineals be mitered precisely and fitted very carefully to the window frame lineals to form a tight fit so that joints at the corners of the window trim are tight and visually acceptable. There is very little room for error in the cutting and fitting of the trim lineals. Further, driving fasteners such as screws into the window frame lineals can create air and/or water leaks, particularly for contain-and-drain type window frames. Accordingly, this technique also has not proven completely satisfactory.

Extruded window frames and trim such as those discussed above and others often are used in "overfit" window installations. An overfit installation is one in which a new replacement window frame is inserted inside and around an existing window frame that is left in place in the window opening due to removal and repair difficulties and cost, and to obtain installation time reduction. Overfit frames and trim typically are used, for example, in window replacement applications where removal of an old window frame requires cutting or breaking stucco siding (or other siding) in order to remove the old window frame. Removal of a window frame installed in a stucco covered building is expensive and difficult because of the time required to remove and repair the stucco after window removal. Further, stucco repair creates areas in which cracks can propagate as the building weathers. An overfit frame window is installed inside an old existing window frame, which is left in place, so that no stucco is damaged in the process and no consequent repair is required. The exterior trim or flange on the overfit window covers the outside surface of the old window frame and part of the exterior wall of the structure.

Such an installation is exemplified in cross section in FIG. 3, which shows an old window frame 21 (which is aluminum in this case) installed in a building with stucco façade 22. It can be seen here that a flange 24 of the old window frame extends behind the stucco façade and thus that removal of the old frame 21 would result in destruction of the stucco around the window opening. Instead, the old window frame is left in place and an overfit window frame 23 is installed inside the old window frame. Trim 26 extends outwardly from the overfit frame to cover the trim of the old window or the region of the building surrounding the window opening. The window trim system and method of the present disclosure is particularly suited for use in overfit replacement window installations; however, it certainly is not limited to overfit installations and may be used in other replacement window installations or even new construction if desired.

Thus, a need exists for a window and window trim system and method that addresses and overcomes the shortcomings and problems of the prior art, some of which are discussed above. It is to the provision of such a window and window trim system and method that the present invention is primarily directed.

SUMMARY

U.S. provisional patent application No. 61/327,153, to which priority is claimed above, is hereby incorporated by reference in its entirety.

Briefly described, the present invention, in a preferred embodiment thereof, comprises a window and window trim system that converts a standard window frame into a frame suitable for an overfit window installation, or simply provides for adding decorative trim to window frames. A window trim hoop is formed by joining specially profiled trim lineals at their ends to form a trim hoop similar in shape to a picture frame. The trim hoop has inner dimensions that are slightly larger than the outer peripheral dimensions of a corresponding window frame. Friction members such as a spline or spring clip may be installed around the inner periphery of the trim hoop or at other locations, although this is not necessary. In fact, it has been found that eliminating the friction members can be advantageous in many situations. The trim hoop may then be slid onto the window frame from the interior side thereof until it seats against a protruding stop feature such as a flange at the forward edge of the window frame. The friction member, if present, bears against the frame and initially helps hold the trim hoop in place by means of a friction fit and also may provide a measure of forgiveness or tolerance compensating for variations in frame and trim hoop size. Sealant, preferably a structural sealant, is applied at the junction of the trim hoop and window frame preferably on the inside of the trim hoop to secure the trim hoop in place and form a seal against wind and water. A window frame and trim is thus formed from separate extrusions quickly, easily, without the need for precise cutting and joining skills, and without forming holes in the lineals of the window frame. These and other aspects, features, and advantages of the system and method of the invention will become more apparent upon review of the detailed description set forth below taken in conjunction with the accompanying drawing figures, which are briefly described as follows.

DETAILED DESCRIPTION

Figure 1A:
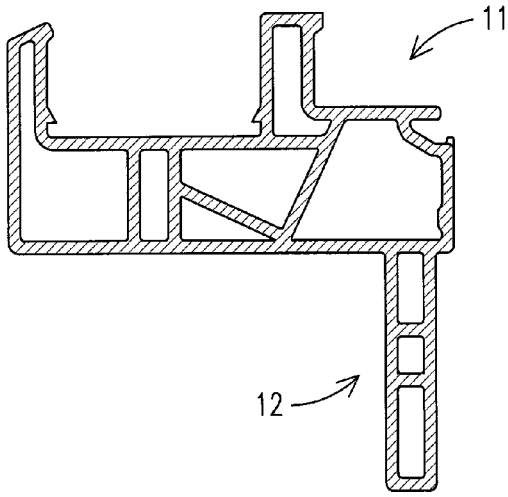
FIG. 1a PRIOR ART
FIGS. 1*a*-1*c*, referenced above, are cross-sectional views of window frames and trims illustrating a prior art technique of forming trim as a unitarily extruded component of a window frame.
Figure 1B:
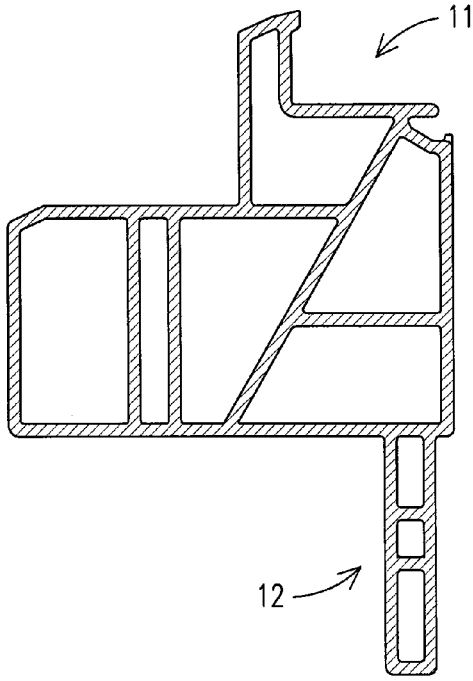
FIG. 1b PRIOR ART
Figure 1C:
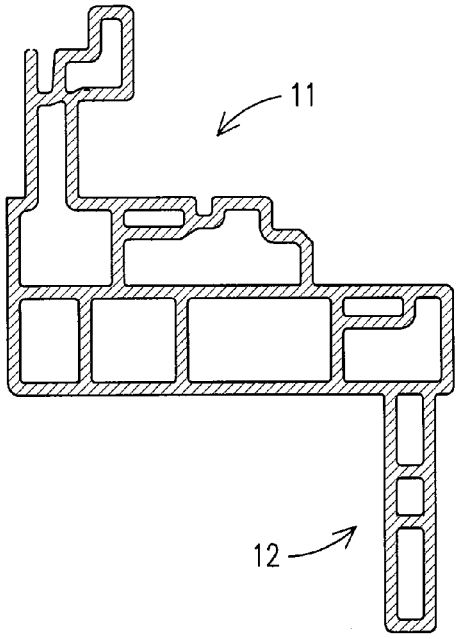
FIG. 1c PRIOR ART
Figure 2A:
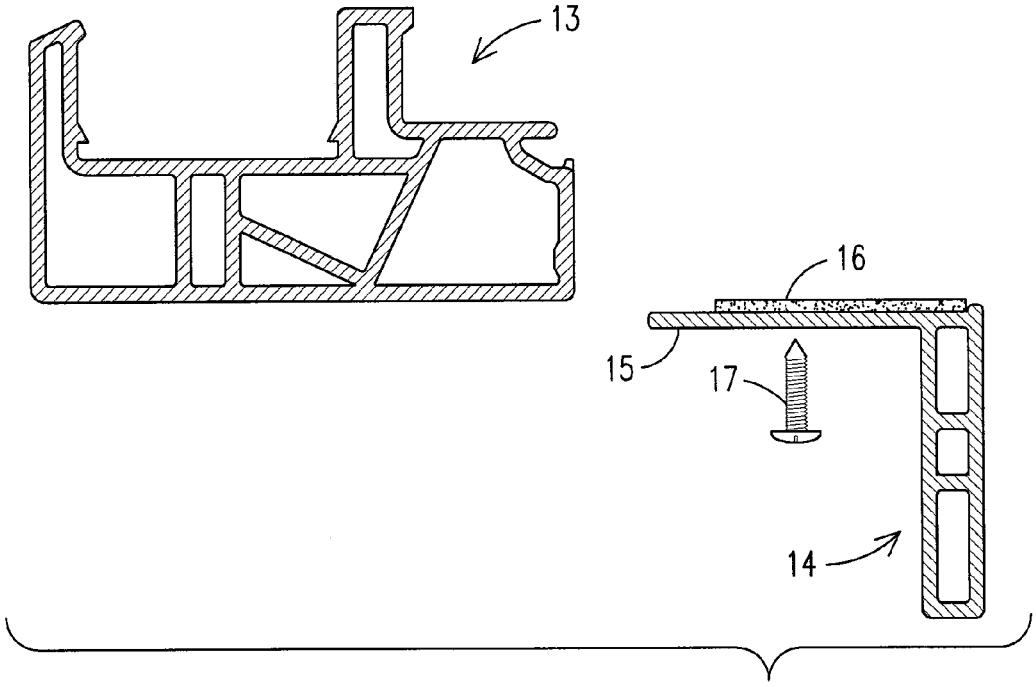
FIG. 2a PRIOR ART
FIGS. 2*a* and 2*b*, also referenced above, are cross-sectional views of a window frame and trim illustrating a prior art technique for joining a separate window trim to a window frame using foam tape and/or screws.
Figure 2B:
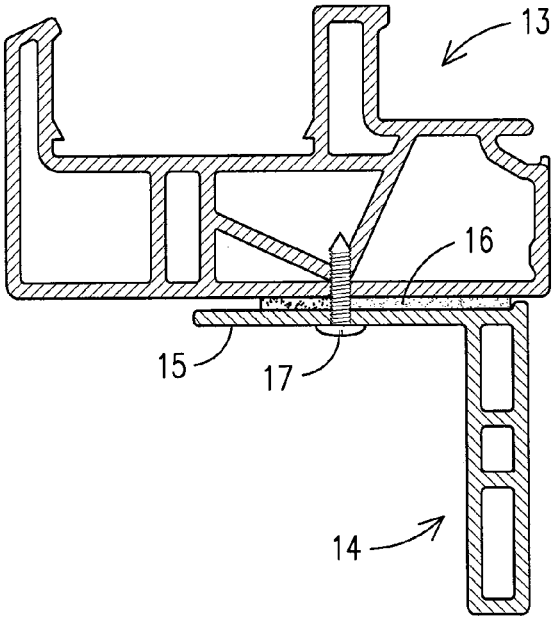
FIG. 2b PRIOR ART
Figure 3:
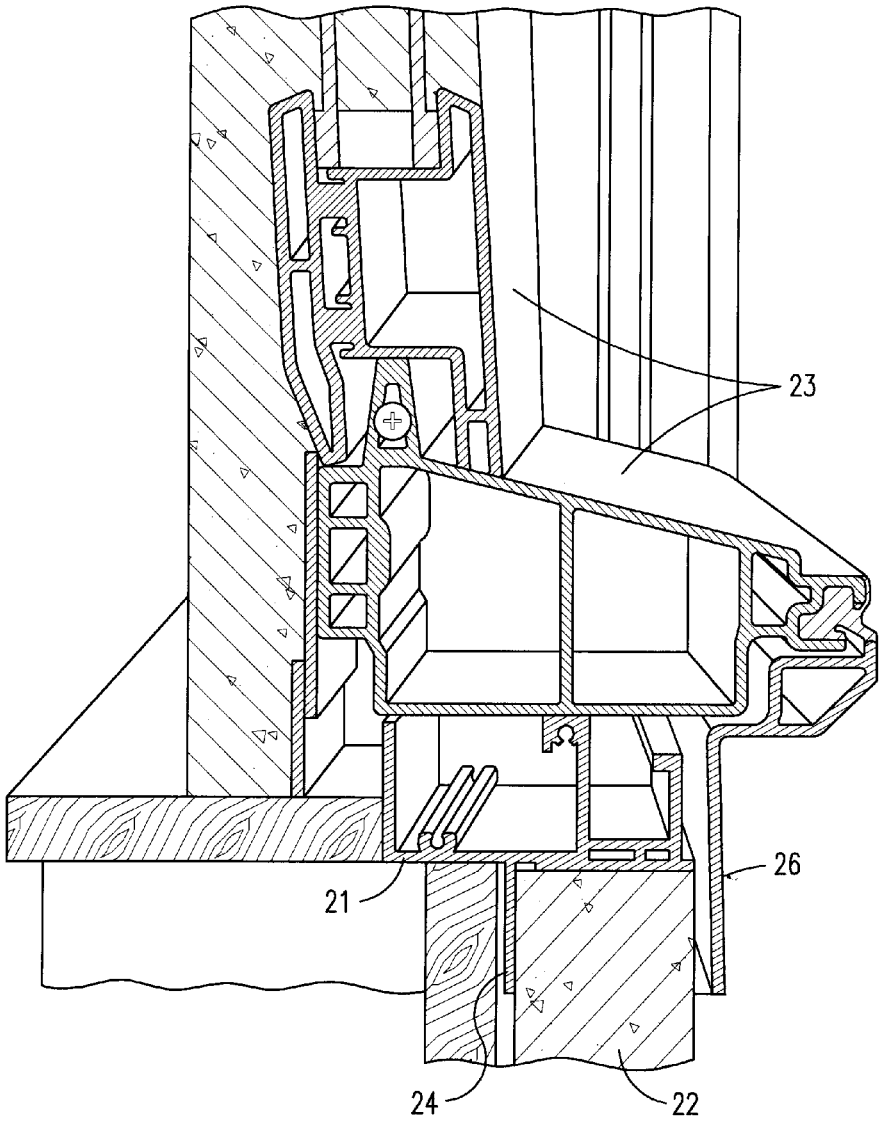
FIG. 3 PRIOR ART
FIG. 3 is a partially cross-sectioned view of an overfit window installation illustrating mounting of a replacement window frame within an old window frame without removing the old frame.

Referring now in more detail to the drawing figures, wherein like reference numerals refer to like parts throughout the various views, FIGS. 1-3 illustrate various aspects of traditional extruded window frame and trim systems and certain drawbacks thereof. These figures have been referred to above in the background section of this disclosure.

Figure 4:
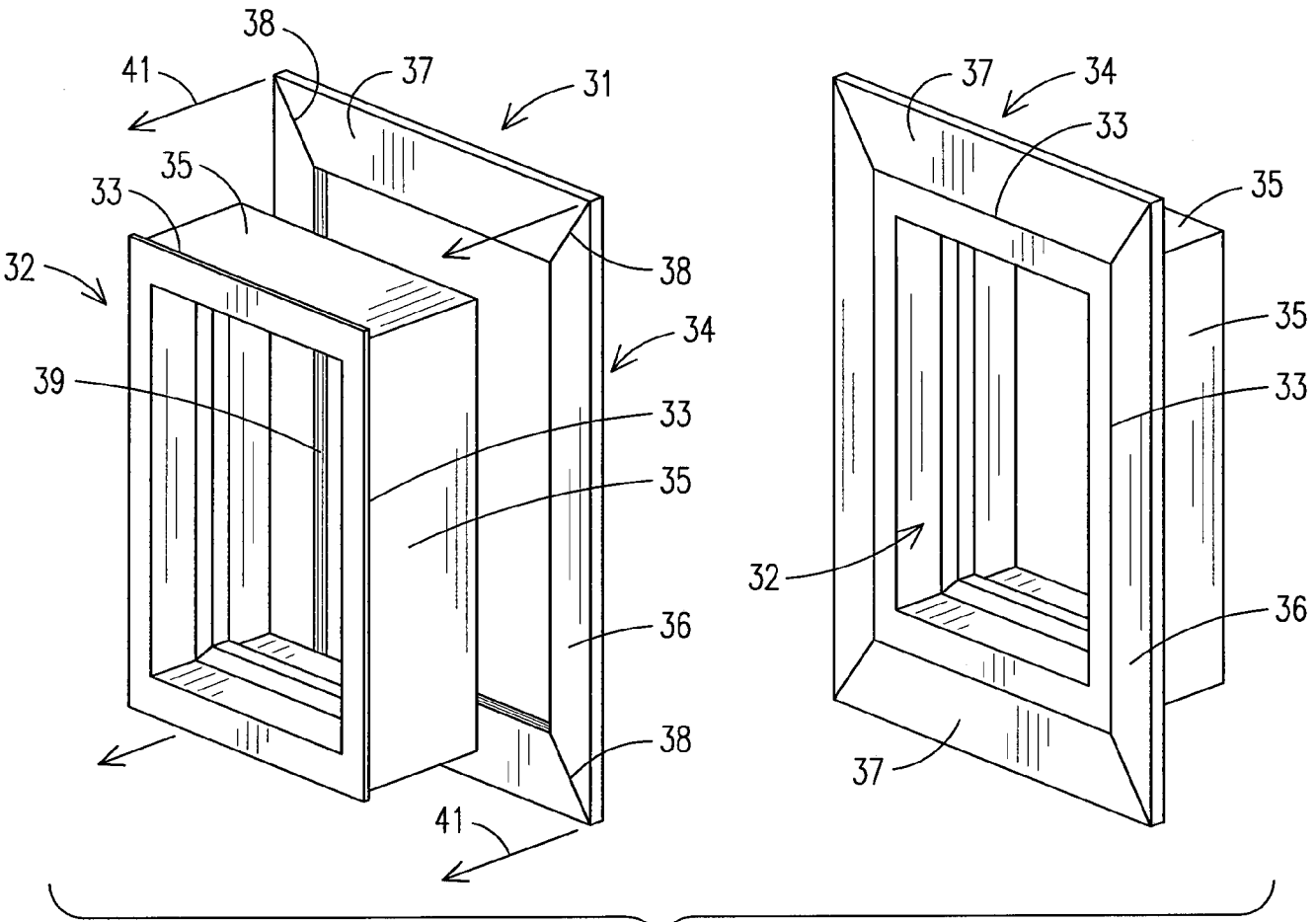
FIG. 4 illustrates a system and method of mounting window trim onto a window frame according to one embodiment of the present invention.

Referring in more detail to the left hand image of FIG. 4, which illustrates an embodiment of the present invention, a window frame 32 of a fenestration unit 31 is formed of horizontal and vertical lineals and has an outer peripheral face 35. A stop feature 33, a flange in this case, preferably is extruded as a component of the lineals so that it extends around the exterior edge and projects proud of the outer peripheral face of the window frame 32. The window frame 32 is illustrated in FIG. 4 in greatly simplified form for clarity; however, it will be understood by those of skill in the art that the lineals forming the window frame can have various complex profiles for accommodating sashes, weather stripping, etc. and the window can be virtually any type of window.

A trim hoop 34 is generally rectangular in the illustrated embodiment (although it can be any desired shape) and is formed of vertical lineals 36 and horizontal lineals 37 joined at their ends at joints 38. The joints 38 in the illustrated embodiments are miter joints; however any type of joint suitable for joining the lineals together might be substituted with equivalent results. More specifically, the lineals 36 and 37 of the trim hoop 34 may be joined together at their ends, for instance, by corner keys, any number of mechanical fasteners, gaskets, adhesives, heat or sonic welding, or combinations thereof. Again, the trim hoop is illustrated as a simplified rectangular profile for clarity in the figures, but may have virtually an architectural profile such as a brick mould profile, for example. In fact, a selection of trim in various architectural styles is envisioned to be and is within the scope of the invention such that a desired architectural trim can be paired with virtually any window frame.

The trim hoop is mounted to the window frame by being slid over the frame as indicated by arrows 41. A friction member 39 may or may not extend around the inside of the trim hoop 34 if desired for initially holding the trim hoop in place on the window frame and providing a measure of tolerance, as discussed in more detail below. The friction member also may be inserted after the trim hoop is slid onto the window frame, or may be located on the window frame just inside the stop member. Alternatively, the friction member need not be included at all and can be eliminated if desired with little or no adverse impact. In fact, it has been found that elimination of the friction feature actually provides additional space between the trim hoop and the window frame within which sealant and/or adhesive can flow, resulting in an improved bonding of the trim hoop to the window frame.

The right hand image in FIG. 4 shows the window frame and trim hoop combination after the trim hoop is slid onto the window frame. It will be seen that the stop member 33 provides a stop around the exterior edge of the window frame. The trim hoop engages the stop member, which prevents the trim hoop from sliding off the front of the window frame and also helps to align and position the trim hoop properly on the window frame. If a friction member is present, the trim hoop may be held in place initially with a friction fit provided by the friction member 39. Otherwise, the trim hoop simply resides against the stop member to position it correctly on the frame. A bead of sealant such as silicone, or a bead of caulk, adhesive, or the like is applied along the junction of the trim hoop and frame on the inside of the trim hoop. This secures the trim hoop permanently to the frame and provides a water and air tight seal between the trim hoop and frame. It will thus be seen that a window frame with trim is fabricated by forming a trim hoop of the appropriate size and architecture, sliding it over the window frame, and securing it in place with sealant.

Figure 5:
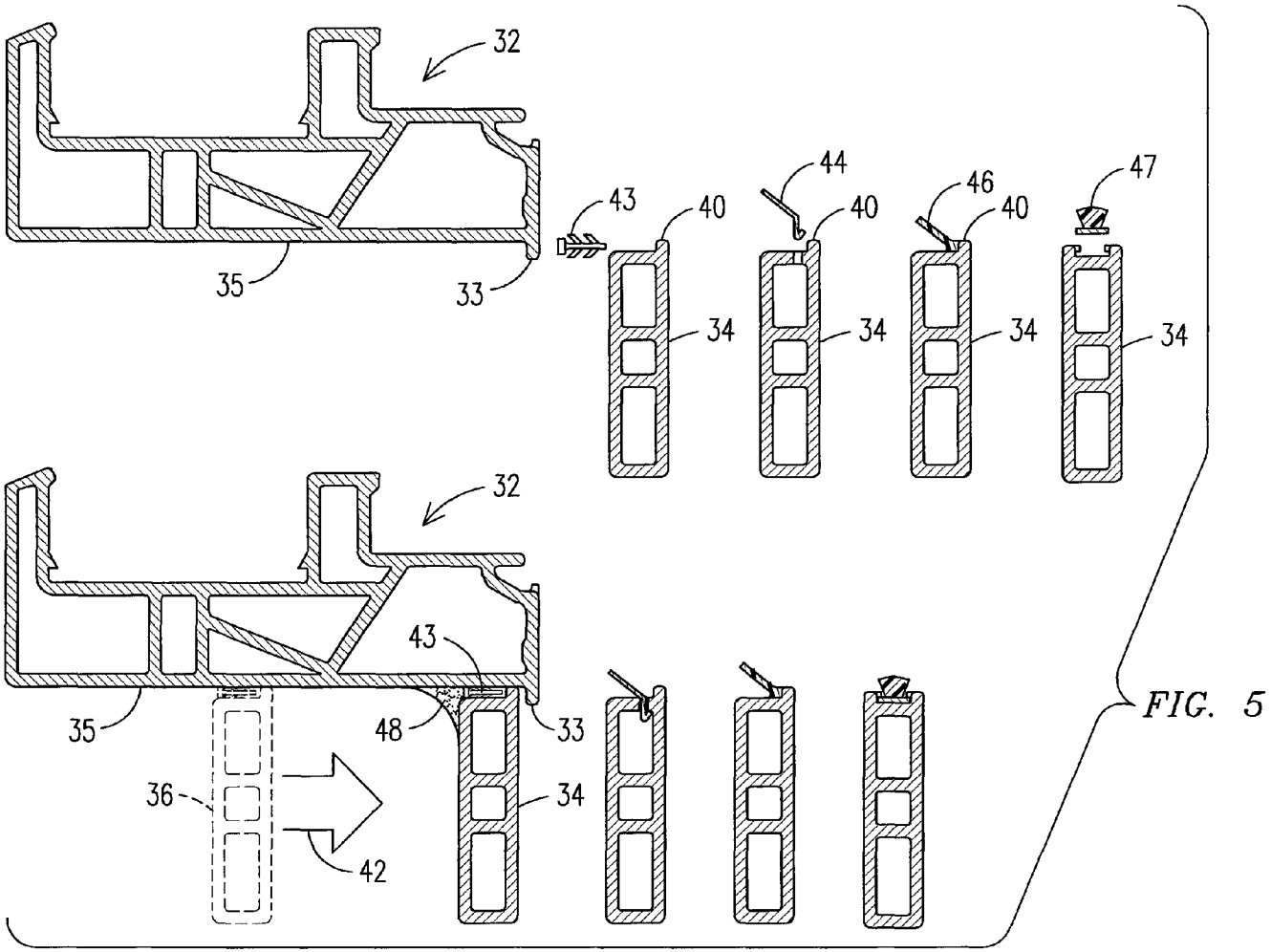
FIG. 5 illustrates in cross-section the fit of a trim hoop around a frame according to the invention and various possible embodiments of friction members around the inside of the trim hoop.

FIG. 5 illustrates the system and method of this invention in more detail in the form of cross-sectional images of a window frame 32 and a trim hoop 34 to be installed thereon as discussed. The window frame lineal and trim hoop lineals are shown as extruded components, and may be extruded from PVC, a composite such as Fibrex®, or another appropriate material. However, the invention is not necessarily limited to extruded lineals and may be embodied, for instance, in wooden frames and trim. In any event, the window frame 32 has an outer peripheral face 35 that terminates at the exterior edge of the frame in a stop feature 33. The stop feature 33 projects proud of the face 35 and can be a standard unitarily formed feature in some extruded window frames such as the Andersen 100 series window. The trim hoop 34 is illustrated with a simple rectangular profile for clarity, but may be extruded, milled, or otherwise formed with any desired profile to match a selected architectural style. If a friction member is included, it preferably extends around the inner peripheral edge of the trim hoop.

To the upper right in FIG. 5 is illustrated some possible configurations of a friction member that can be used if desired and it will be understood that other configurations are possible. From left to right are illustrated a flexible press-in spline 43, a metal spring clip 44, a co-extruded flexible leg 46, and an edge-mounted weatherstrip 47. The press-in spline 43 may be pressed into the gap between the inner peripheral edge of the trim hoop 34 and the outer peripheral face 35 of the window frame 32 after the trim hoop is slid onto the frame, and in some aspects can abut a hoop flange 40 that projects inward from the inner peripheral edge of the trim hoop 34.

The exterior or front surface of the hoop flange 40 may be an extension of the exterior or front face of the trim hoop 34, and therefore may contact the stop feature 33 of the window frame 32 when the trim hoop is assembled to the window frame. The other illustrated friction members are secured to the inner peripheral edge or to the hoop flange 40 of the trim hoop and deform as the trim hoop is slid onto the window frame. In either case, the friction member exerts pressure on the outer peripheral face 35 and thereby creates friction that holds the trim hoop in place at least initially on the window frame. In addition, the friction member allows for greater tolerances in the size of the frame so that less precise cutting and joining is required than with some prior art systems.

The lower left image in FIG. 5 illustrates application of a trim hoop, in this case the one with the press-in spline friction member, to a window frame. As shown in phantom lines, the trim hoop 34 is slid onto the frame 32 from the interior edge toward the exterior edge as indicated by arrow 42. At the exterior edge, the trim hoop engages the stop feature 33 of the window frame, which aligns the trim hoop 34 and prevents it from slipping off of the exterior edge of the window frame. A friction member 43, if one is included, initially holds the trim hoop in place by creating friction between the trim hoop and the frame. Otherwise, the hoop rests against the stop feature to position the hoop properly on the frame. With the trim hoop in position, a bead of sealant or caulk or adhesive or a combination 48 is applied along the junction of the trim hoop and the frame to secure the trim hoop permanently in place and to create an air and water seal, as mentioned above. If no friction member 43 is used, the sealant has been found to flow freely between the trim hoop and the outer peripheral face of the window frame to enhance the bond and seal therebetween. A window frame with trim is thus formed.

The window trim system and method of this invention offers the advantages of being simple to fabricate, easy to install on a window frame, and simple to seal against air and water infiltration. The trim hoop lineals or profiles are relatively easy to cut and join together to form the trim hoop and this can be done during fabrication in a manufacturing facility or even on sight by an installer. Excessive skill and precision are not required. The trim can be fabricated in varying shapes and colors to match desired cosmetic requirements without the cost of much more complex full-frame tooling. The trim lineals can be run through a table saw to shorten them in overfit applications in which the frames are inset from the outside plane of a wall. Prior art trim systems are significantly more complicated and difficult to install and seal. They typically are installed one piece at a time, which makes corner joining difficult and requires very precise cutting of the trim lineals. If friction members are included (they are not necessary) they may allow more forgiveness in the size of the trim hoop and promote precision corner joining that is accurate and gapless. Prior art unitarily extruded frame and trim solutions are expensive to tool and not easily adapted for color or shape variations.

As mentioned, the present invention is particularly useful to create overfit replacement windows where old window frames are left in place and the replacement window and trim are slid past the old frame. It will be clear; however, that the invention is not limited to overfit installations, but applies to virtually any window installation where a trim is to be added to a window frame before installation.

The invention has been described herein in terms of preferred embodiments and methodologies considered by the inventors to represent the best mode of carrying out the invention. It will be understood by those of skill in the art, however, that a wide range of additions, deletions, and modifications both subtle and gross might well be made to the illustrated embodiments without departing from the spirit and scope of the invention, which is significantly broader than the illustrated embodiments thereof.

What is claimed is:

1. A window trim system comprising:

a window frame having an outer peripheral face, a first edge, and a second edge;

a stop feature extending around the first edge of the window frame and projecting proud of the outer peripheral face;

a trim hoop having an inner peripheral edge sized to be slid onto the window frame from the second edge thereof and to abut the stop feature at the first edge of the window frame to position and align the trim hoop, and an exterior face extending outward beyond the stop feature; and a material for securing the trim hoop in place on the window frame when the trim hoop is positioned and aligned against the stop feature.

2. A window trim system as claimed in claim 1 and wherein the first edge comprises an exterior edge of the frame.

3. A window trim system as claimed in claim 2 and wherein the second edge comprises an interior edge of the frame.

4. A window trim system as claimed in claim 1 and wherein the window frame is generally rectangular in shape.

5. A window trim system as claimed in claim 1 and wherein the trim hoop is formed of trim members secured together at their ends.

6. A window trim system as claimed in claim 5 and wherein the trim hoop is generally rectangular in shape.

7. A window trim system as claimed in claim 1 and wherein the stop feature comprises a flange.

8. A window trim system as claimed in claim 7 and wherein the flange extends substantially continuously around the window frame.

9. A window trim system as claimed in claim 1 and wherein the material for securing the trim hoop in place comprises an adhesive.

10. A window trim system as claimed in claim 1 and wherein the material for securing the trim hoop in place comprises a sealant.

11. A window trim system as claimed in claim 1 and wherein the material for securing the trim hoop in place comprises a caulk.

12. A window trim system as claimed in claim 1 and further comprising a friction member configured to be located between the trim hoop and the window frame when the trim hoop is positioned against the stop feature.

13. A window trim system as claimed in claim 12 and wherein the friction member is located on the trim hoop.

14. A window trim system as claimed in claim 13 and wherein the friction member extends around the inner peripheral edge of the trim hoop.

15. A window trim system as claimed in claim 12 and wherein the friction member is selected from a group consisting of a flexible press-in spline, a metal spring clip, a co-extruded flexible leg, and an edge-mounted weatherstrip.

16. A fenestration unit comprising a frame having a peripheral flange projecting outwardly from one edge thereof, a trim hoop surrounding the frame, abutting the peripheral flange, and having an exterior face extending outward beyond the peripheral flange, and a material at the junction of the frame and the trim hoop securing the frame and the trim hoop together.

17. A fenestration unit as claimed in claim 16 and wherein the fenestration unit comprises a window.

18. A fenestration unit as claimed in claim 16 and further comprising a friction member located between the frame and the trim hoop.

19. A fenestration unit as claimed in claim 18 and wherein the friction unit is selected from the group consisting of a flexible press-in spline; a metal spring clip, a co-extruded flexible leg, and an edge-mounted weatherstrip.

20. A fenestration unit as claimed in claim 16 and wherein the material comprises a sealant, an adhesive, a caulk, or a combination thereof.

* * * * *